US005138295A

United States Patent [19]

Larson et al.

[11] Patent Number: 5,138,295

[45] Date of Patent: Aug. 11, 1992

[54] ELECTRICAL TRANSFORMER ARRANGEMENT WITH PLATE INSULATORS

[75] Inventors: John A. Larson, Portage, Wis.; Henry Pikul, Chicago, Ill.

[73] Assignee: North American Philips Corporation, New York, N.Y.

[21] Appl. No.: 777,989

[22] Filed: Oct. 17, 1991

[51] Int. Cl.[5] ..... H01F 27/30

[52] U.S. Cl. ..... 336/160; 336/198; 336/212

[58] Field of Search ..... 336/160, 165, 155, 196, 336/198, 209, 212, 234

[56] References Cited

U.S. PATENT DOCUMENTS

| | | | |
|---|---|---|---|
| 2,559,805 | 7/1951 | Schneider | 336/198 |
| 3,609,859 | 10/1971 | Hunt et al. | 336/198 |
| 4,216,455 | 8/1980 | Hester | 336/160 |
| 4,812,798 | 3/1989 | Chappel | 336/198 |

*Primary Examiner*—Thomas J. Kozma
*Attorney, Agent, or Firm*—Robert T. Mayer

[57] ABSTRACT

A transformer in which the tops and bottoms of both the primary and secondary coils are insulated from the magnetic circuit by substantially flat plate plastic insulators adjacent both the top and bottom of both coils.

5 Claims, 3 Drawing Sheets

ELECTRICAL TRANSFORMER ARRANGEMENT WITH PLATE INSULATORS

This is an invention in the electromechanical art. More particularly, it involves an arrangement for an electrical transformers which is significantly less costly than previous arrangements for such transformers.

It is an object of this invention to provide improved transformers for use in ballast systems for gas discharge lamps.

One of the advantages of the invention is that it simplifies the manufacturing process involved in producing ballast transformers for gas discharge lamps.

Another o the advantages of the invention is that it improves the consistency of performance of ballast transformers for gas discharge lamps.

One of the features of the invention is the provision of components which provide self-centering for the coils of ballast transformers for gas discharge lamps.

In carrying out the invention there is provided a transformer including a T-shaped laminated iron core with an insulating wrapper surrounding a substantial length of the leg of the core. A first apertured substantially flat plate insulator is fitted over the iron core. The plate insulator has sides long enough and wide enough to cover the tops of the legs of the cross-bar of the T-shaped iron core. A first coil with a top with two sides is fitted over the iron core and insulated from the legs of the iron core by the sides of the first aperture flat plate insulator. A second apertured substantially flat plate insulator similar to the first apertured flat plate insulator is also fitted over the iron core. This second apertured substantially flat plate insulator has sides long enough and wide enough to cover the two sides of the top of the first coil. A pair of electrical shunts are situated on top the sides of the second apertured flat plate insulator. A third apertured substantially flat plate insulator similar to the first and second apertured flat plate insulators and having sides is also fitted over the iron core. A second coil with a top and a bottom both with two sides is also fitted over the iron core. The bottom two sides of the second coil is insulated from the shunts by the two sides of the third apertured flat plate insulator. A fourth apertured substantially flat plate insulator similar to said first, second and third apertured flat plate insulators is also fitted over the iron core and provides insulation for the top two sides of the second coil.

Other objects, features and advantages of the invention will be apparent from the following description and appended claims when considered in conjunction with the accompanying drawing in which:

Figure 1:
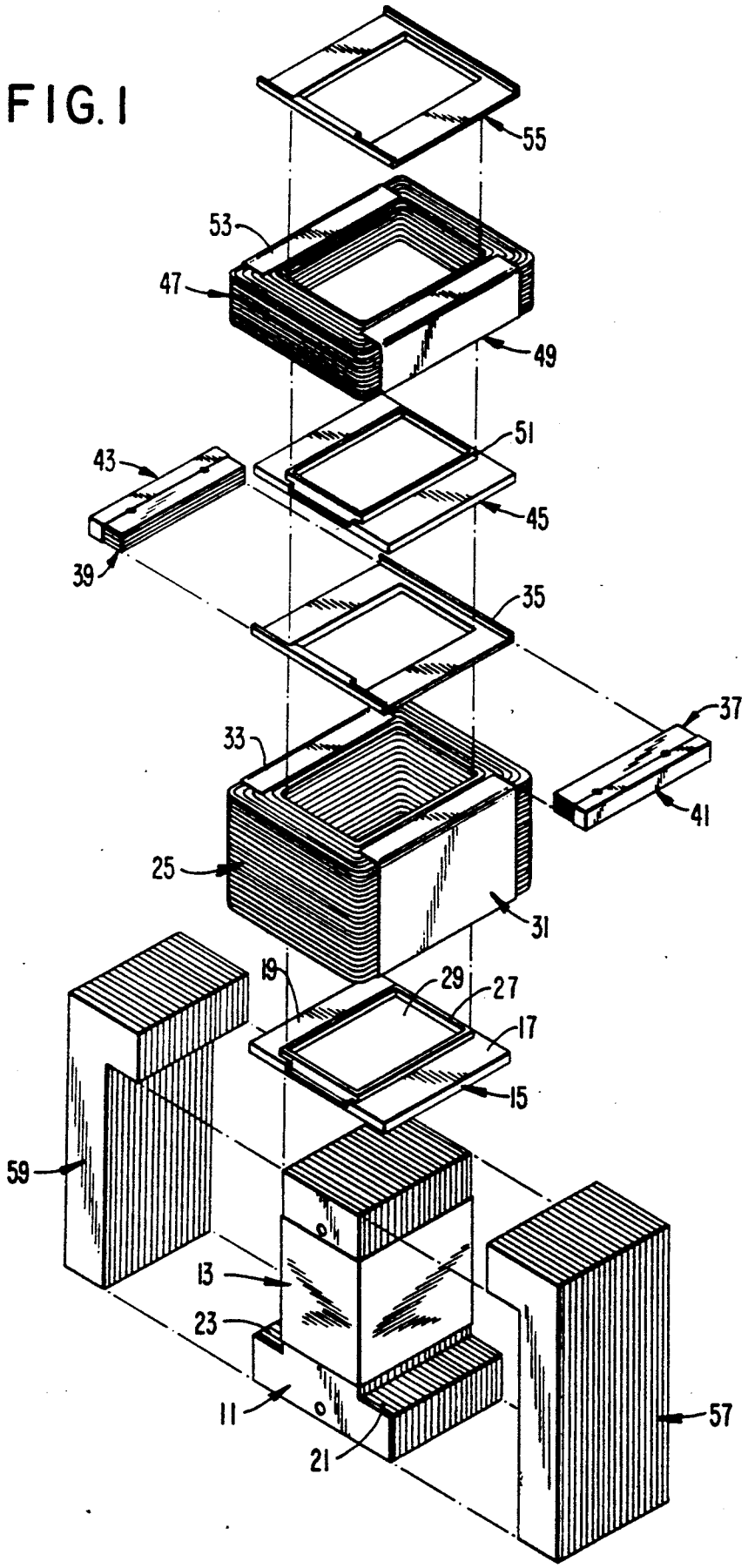
FIG. 1 is an exploded view in perspective of parts of the invention.
Figure 2:
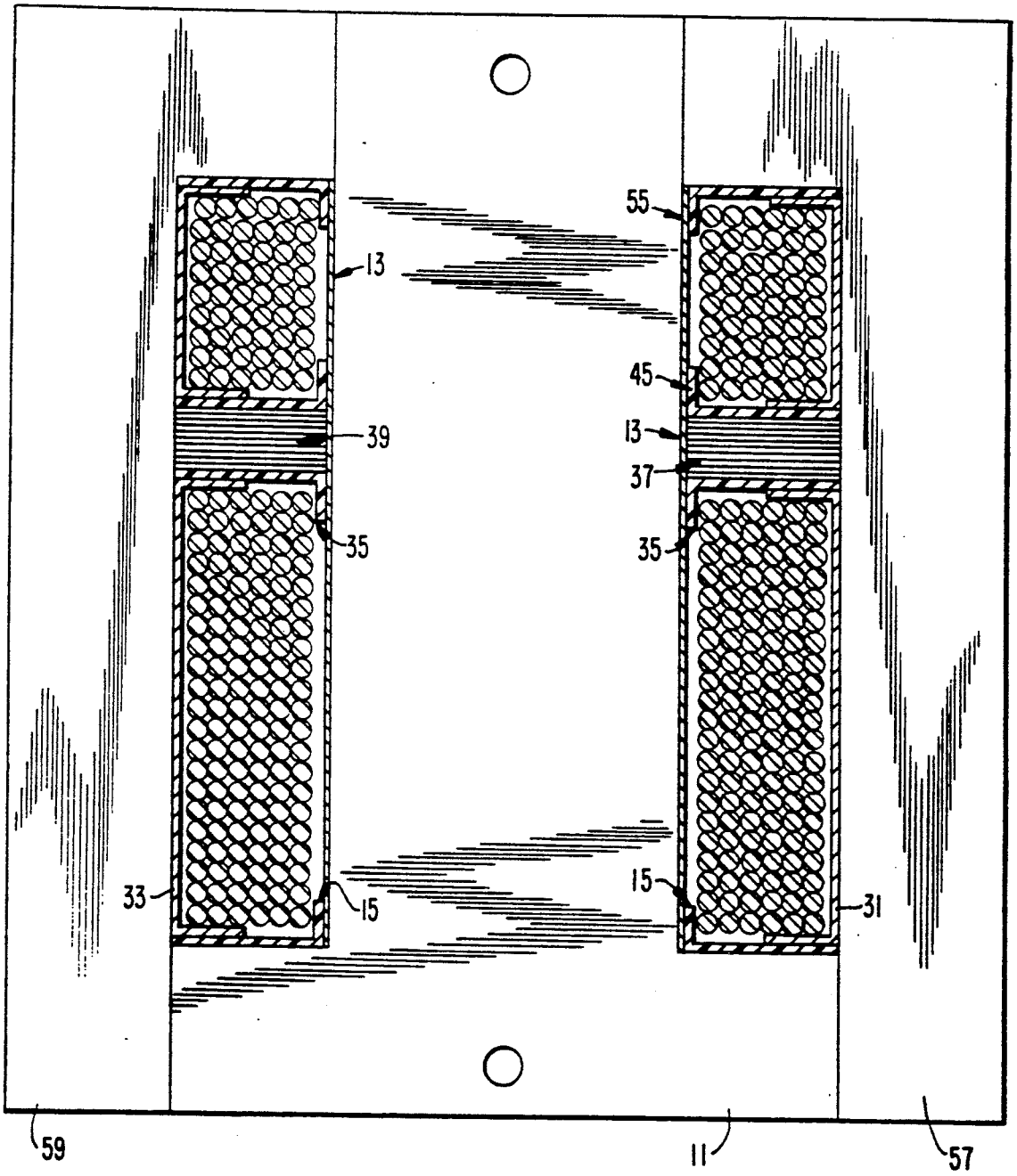
FIG. 2 is a sectional view of a constructed version of the invention.

Referring to FIGS. 1 and 2, there is shown a T-shaped laminated iron core 11. A substantial length of the leg of core 11 is surrounded by insulation paper 13. As constructed a first apertured substantially flat plate insulator 15 is fitted over the leg of iron core 11. This substantially flat plate plastic insulator has sides 17 and 19 which are wide enough and long enough to cover the tops of the legs 21 and 23 of the cross bar of the T-shaped iron core 11. A first coil 25 with a top and a bottom both with two sides is also fitted over the iron core. First coil 25 has its bottom sides insulated from the tops of the legs 21 and 23 of T-shaped iron core 11 by the sides 17 and 19 of the first apertured substantially flat plate insulator 15. First coil 25 is centered on T-shaped iron core 11 by reason of raised edges 27 which surround aperture 29 of first flat plate insulator 15 which are fitted into the aperture of first coil 25. Fastened to the top, the bottom and both sides of coil 25 is insulating material in the form of insulating paper 31 and 33. In a constructed embodiment, first coil 25 was the secondary of a transformer.

Fitted over the leg of iron core 11 is a second apertured substantially flat plate insulator 35. Insulator 35 is substantially the same as insulator 15 but is turned over so that its raised edges, similar to edges 27, are fitted into the aperture in coil 25. Mounted on the sides of insulator 35 are iron shunts 37 and 39. These shunts form a part of the magnetic circuit of the transformer. Insulation in the form of insulating tapes 41 and 43 are taped to the outside of shunts 37 and 39. Mounted on top of shunts 41 and 43 is a third apertured substantially flat plate insulator 45 oriented in the same direction as first apertured insulator 15. Insulator 45 is also fitted over the leg of iron core 11.

A second coil 47 is also fitted over the leg of iron core 11. This coil is in contact with the sides of insulator 45 to insulate it from the iron shunts 37 and 39. Coil 47 is also fitted over the raised edges 51 of insulator 45 to center it with respect to the leg of iron core 11 as first coil 25 is centered by the raised edge 27 of insulator 15. As with first coil 25, second coil 47 also has insulation in the form of insulating paper 49 and 53 covering its two sides and part of its top and bottom. In the forementioned constructed embodiment second coil 47 was the primary of a transformer.

A fourth apertured substantially flat plate insulator 55 is fitted over the leg of iron core 11 and rests on the top of second coil 47. Insulator 55 is oriented the same as insulator 35. This insulator provides insulation from the tops of L-shaped iron bars 57 and 59. Its raised edges, similar to raised edges 51 (not shown), also serve to center coil 47 with respect to the leg of iron core 11.

Figure 3:
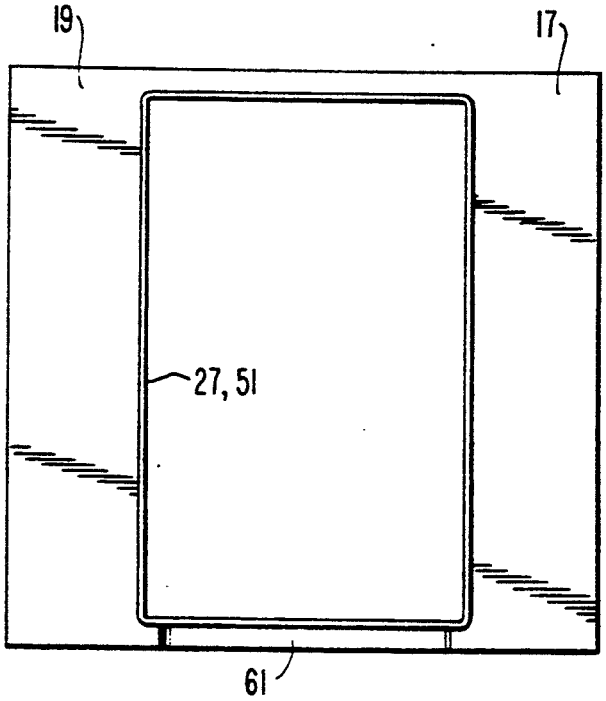
FIG. 3 is a plan view of one of the components of the invention.
Figure 4:
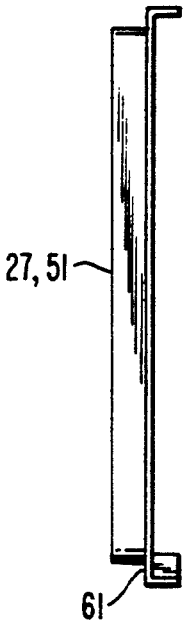
FIG. 4 is a side view of the component shown in FIG. 3.
Figure 5:
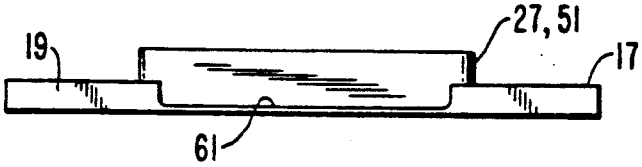
FIG. 5 is a front view of the component shown in FIGS. 3 and 4.

As can be seen from FIGS. 3, 4 and 5 each of the apertured substantially flat plate insulators 15, 35, 45 and 55 has an indentation 61 adjacent to one side of a raised edge identified as 27 and 51 in FIGS. 3, 4 and 5. This indentation is provided in order to provide space to bring out a lead wire from each of the first and second coils should a lead wire be desirable near the ends of such coils.

It should be apparent that various modifications of the above will be evident to those skilled in the art and that the arrangement described herein is for illustrative purposes and is not to be considered restrictive.

What is claimed is:

1. A transformer including a T-shaped laminated iron core with an insulating wrapper surrounding a substantial length of the leg of said core, a first apertured substantially flat plate insulator fitted over said iron core, said first plate insulator having sides long enough and wide enough to cover the tops of the legs of the cross-bar of said T-shaped iron core, a first coil with a top and a bottom both with two sides fitted over said iron core and insulated from the legs of the cross-bar of said iron core by the sides of said first apertured flat plate insulator, a second aperture substantially flat plate insulator fitted over said iron core similar to said first apertured flat plate insulator with sides long enough and wide enough to cover said two sides of the top of said first coil, a pair of shunts atop said sides of said second apertured flat plate insulator, a third apertured substantially flat insulator and having sides similar to said first and second apertured flat plate insulators fitted over said iron core, a second coil with a top and a bottom both with two sides fitted over said iron core, said bottom two sides of said second coil being insulated from said shunts by said two sides of said third apertured flat plate insulator, and a fourth apertured substantially flat plate insulator fitted over said iron core providing insulation for the top two sides of said second coil.

2. A transformer in accordance with claim 1 wherein each of said apertured substantially flat plate insulators has raised edges surrounding its aperture, said raised edges being fitted inside the opening in the coil with which said apertured flat plate insulator is associated.

3. A transformer in accordance with claim 2, wherein each said apertured substantially flat plate insulator has an indentation adjacent the raised edge on one of its sides.

4. A transformer in accordance with claim 3, including two laminated L-shaped iron bars, one leg of each bar abutting one leg of the cross-bar of said T-shaped core, the other leg of each bar abutting the leg of said T-shaped core, each said coil having insulating material on its sides facing the sides of the L-shaped iron bars.

5. A transformer in accordance with claim 4, wherein said shunts also have insulating material on their sides facing the sides of the L-shaped iron bars.

* * * * *